United States Patent [19]

Hase

[11] Patent Number: 4,971,166

[45] Date of Patent: Nov. 20, 1990

[54] MUFFLER

[75] Inventor: Shuichi Hase, Toyota, Japan

[73] Assignee: Sango Co., Ltd., Aichi, Japan

[21] Appl. No.: 306,647

[22] Filed: Feb. 3, 1989

[30] Foreign Application Priority Data

Feb. 8, 1988 [JP] Japan ..... 63-15433[U]

[51] Int. Cl.[5] ..... F01N 1/08

[52] U.S. Cl. ..... 181/254; 181/265; 181/272; 181/282

[58] Field of Search ..... 181/236, 241, 254, 265, 181/266, 272, 282; 60/312

[56] References Cited

U.S. PATENT DOCUMENTS

| | | | |
|---|---|---|---|
| 1,403,614 | 1/1922 | Malsack | 181/254 |
| 2,072,372 | 3/1937 | Kingstey | 181/264 |
| 2,404,589 | 7/1946 | Monaghan | 181/232 |
| 3,620,330 | 11/1971 | Hall | 181/266 |

FOREIGN PATENT DOCUMENTS

| | | |
|---|---|---|
| 0077230 | 4/1982 | European Pat. Off. . |
| 58-126414 | 7/1983 | Japan . |
| 59-520 | 1/1984 | Japan . |
| 60-27719 | 2/1985 | Japan . |
| 60-95112 | 6/1985 | Japan . |
| 0016016 | 10/1985 | Japan . |
| 61-82015 | 5/1986 | Japan . |
| 61-108814 | 7/1986 | Japan . |
| 61-108816 | 7/1986 | Japan . |
| 61-126020 | 8/1986 | Japan . |
| 61-126022 | 8/1986 | Japan . |
| 61-1122315 | 8/1986 | Japan . |
| 61-142113 | 9/1986 | Japan . |
| 62-24007 | 2/1987 | Japan . |
| 62-54210 | 4/1987 | Japan . |
| 6341911 | 12/1911 | United Kingdom . |

*Primary Examiner*—Benjamin R. Fuller
*Attorney, Agent, or Firm*—Ladas & Parry

[57] ABSTRACT

A muffler for an internal combustion engine comprises: a communicating passage constituting member allowing a plurality of chambers formed by partitioning walls inside an outer shell to be communicated with each other; and a butterfly-type valve provided in the communicating passage. The communicating passage constituting member is formed into the shape of a gutter so as to face either an inner surface of the outer shell at an open side of the constituting member or an outer surface of the outer shell at an open side of the constituting member. Alternatively, the communicating passage constituting member is constituted by a pipe and is provided in the outer shell. The arrangement makes it possible to improve the engine output, reduce the back pressure, and enhance the sound-damping effect.

8 Claims, 2 Drawing Sheets

MUFFLER

BACKGROUND OF THE INVENTION

The present invention relates to a muffler, preferably for an internal combustion engine.

A known muffler of this type is disclosed in, for instance, Japanese Patent Unexamined Publication No. 60-27719. This muffler is arranged such that the interior of the muffler is partitioned into a plurality of chambers communicating with each other through an inner pipe, and this inner pipe is provided with an opening and closing valve which opens and closes in correspondence with the engine rotational speed. Thus, the opening and closing of the valve is controlled in accordance with given objectives. For instance, when the engine rotational speed is normal, the opening and closing valve is opened to reduce the internal pressure of the muffler, thereby reducing fuel consumption. When the engine rotational speed is low, emphasis is placed on the sound-damping effect rather than on back pressure, so that the opening and closing valve is closed. On the other hand, when the engine rotational speed is high, emphasis is placed on a high output through reduced back pressure rather than on the sound-damping effect, so that the opening and closing valve is opened.

In addition, the aforementioned publication also discloses a muffler in which, as shown in FIG. 6, a plate valve 3 is provided slidably in an inlet pipe 2 disposed in an outer shell 1, and the plate valve 3 is urged by a spring 4. In a medium-speed region, the plate valve 3 is closed by the urging force of the spring 4, while, in a high-speed region, the plate valve 3 is closed by the flow of an exhaust gas against the urging force of the spring 4.

Furthermore, the same publication discloses another muffler which is arranged such that, as shown in FIG. 7, an opening and closing valve 6 is provided on the exhaust port side of an inner pipe 5 within an outer shell 1 in a face-to-face relationship, and this opening and closing valve 6 is moved forward and backward by a moving member 7 so as to open and close the inner pipe 5.

With the above-described structures, however, there is a problem in that when the opening and closing valve 3 or 6 opening the flow of the exhaust gas is restricted by coming into contact with the entire opposing surface of the opening and closing valve 3 or 6, and the back pressure therefore becomes high.

SUMMARY OF THE INVENTION

Accordingly, it is an object of the present invention to provide a muffler which is capable of overcoming the above-described problem.

To this end, according to the present invention provides a muffler comprising: a communicating passage constituing member allowing a plurality of chambers formed by partitioning walls inside an outer shell to be communicated with each other; and a butterfly-type valve provided in the communicating passage.

DESCRIPTION OF THE PREFERRED EMBODIMENTS

Referring now to the accompanying drawings, a description of the embodiments will be given according to the present invention.

Figure 1:
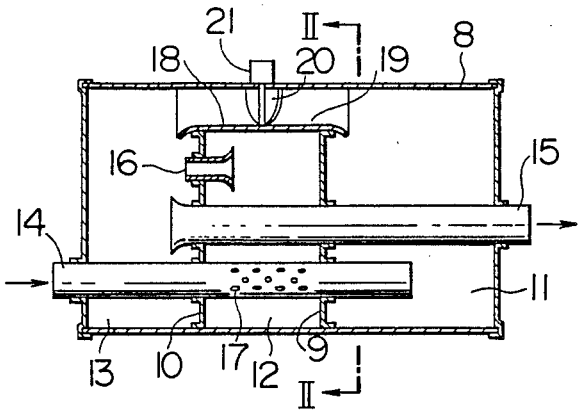
FIG. 1 is a sectional side-elevational view illustrating an embodiment of a muffler according to the present invention.
Figure 2:
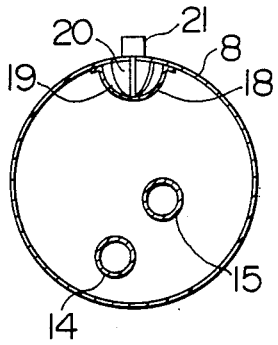
FIG. 2 is a cross-sectional side view taken along the line II—II in FIG. 1.

In a embodiment according to the present invention which is illustrated in FIGS. 1 and 2, the interior of an outer shell 8 is partitioned by partition walls 9, 10 into a first chamber 11, a second chamber 12 and a third chamber 13. An end of an inlet pipe 14 is open into the first chamber 11, while an end of an outlet pipe 15 is open into the third chamber 13. An inner pipe 16 allows the second chamber 12 and the third chamber 13 to communicate with each other. Communication holes 17 which are formed on the inlet pipe 14 are open in the second chamber 12. A gutter-shaped communication passage constituting member 18 is arranged along the inner surface of the outer shell 8, facing the inner surface of the outer shell 8 at its open side, and is secured to the outer shell 8. Thus, a passage 19 by which the first chamber 11 and the third chamber 13 communicates is formed of the communicating passage constituting member 18 and the outer shell 8. A butterfly-type valve 20 for opening and closing the communicating passage 19 is rotatably provided in the communicating passage 19. The valve 20 is openably driven by a driving member 21 provided on the outside of the outer shell 8.

In accordance with the above-described arrangement of the invention, with the valve 20 closed, the first chamber 11 serves as a resonance chamber, and an exhaust gas from the inlet pipe 14 flows into the second chamber 12 through the communicating holes 17, passes through the inner pipe 16 and the third chamber 13, and is discharged through the output pipe 15. Except for the pipe 14, through which exhaust gas flows into the chamber 11, the chamber 11 is sealed from the chamber 12 by the wall 9. Thus, when the valve 20 is closed, there is no significant path for gas from the chamber 11 to the chamber 13 via the chamber 12.

In addition, with the valve 20 opened, the first chamber 11 serves as an expansion chamber, and a part of the exhaust gas from the inlet pipe 14 passes through the first chamber 11, the communicating passage 19 and the third chamber 13 and is discharged through the outlet pipe 15. At this time, since the valve 20 is of the butterfly type, circulation resistance of the exhaust gas flow circulated through the communicating passage 19 is small. For that reason, the back pressure produced by the circulation resistance becomes small.

Figure 3:
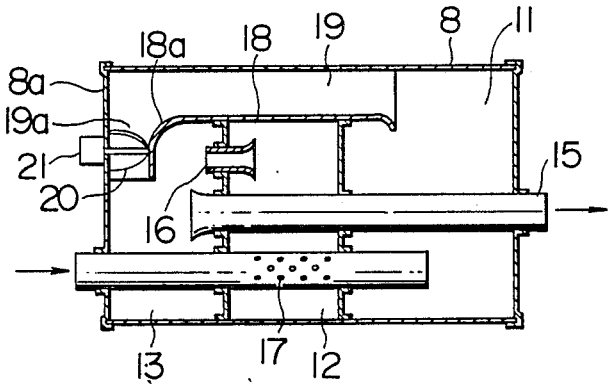
FIGS. 3 to 5 are cross-sectional views illustrating three other embodiments according to the present invention, respectively.
Figure 6:
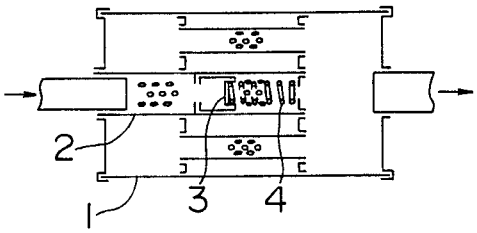
FIG. 6 PRIOR ART
FIGS. 6 and 7 are cross-sectional side views illustrating two examples of a conventional muffler.
Figure 7:
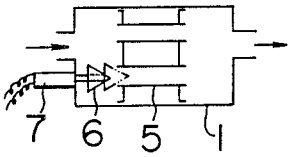
FIG. 7 PRIOR ART

FIG. 3 shows a second embodiment according to the present invention, which is arranged such that at a downstream end 18*a* the above-described communicating passage constituting member 18 is bent in parallel with an outer plate 8*a* of the outer shell 8 to form a communicating passage 19, and a butterfly-type valve 20 which is similar to the above-described one is provided in a bent portion 19*a* thereof. This embodiment can perform the same operation and have the same advantages as the above-described embodiment.

Figure 4:
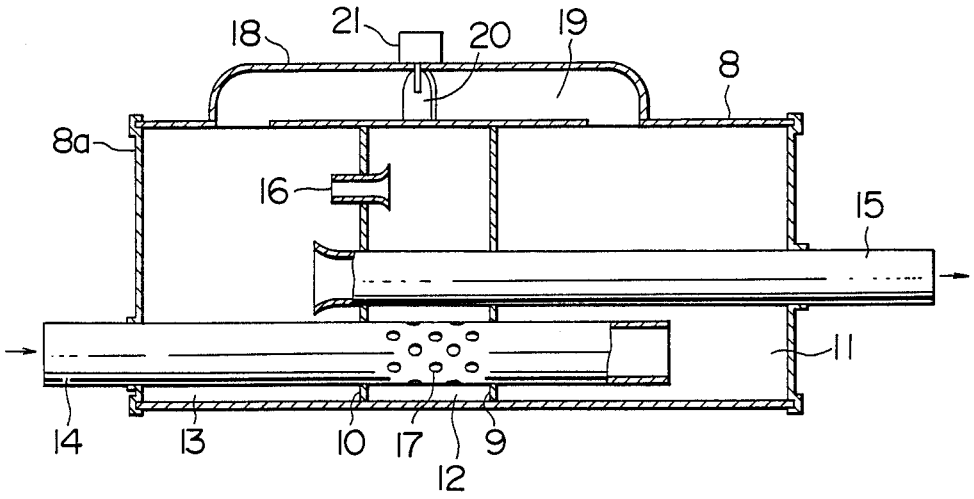

FIG. 4 illustrates a third embodiment according to the present invention which is arranged such that the aforementioned communicating passage constituting member 18 is formed into the shape of a gutter so as to face the outer surface of the outer shell 8 at the open side of the constituting member 18. It should be noted that opposite ends of the communicating passage constituting member 18 are bent toward the outer surface of the outer shell 8, and communicating openings are formed on the outer shell 8 for communication with the first chamber 11 and the third chamber 13.

Figure 5:
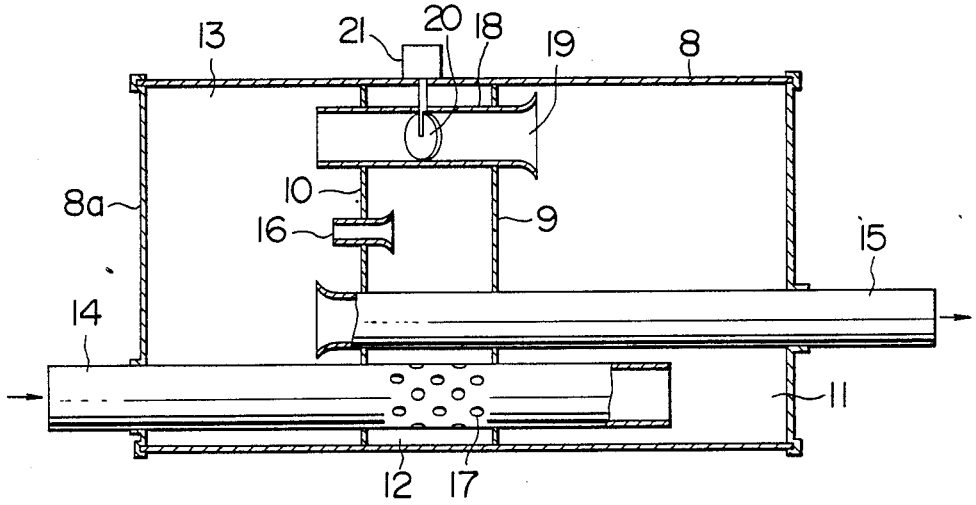

FIG. 5 illustrates a fourth embodiment of the present invention, which is arranged such that the aforementioned communicating passage constituting member 18 is constituted by a pipe, and is provided in the outer shell 8 to allow the first chamber 11 and the third chamber 13 to be communicated with each other.

As described above, according to the present invention, when the engine rotational speed is low and the load is light, one chamber disposed in the muffler can be used as a low-frequency resonance chamber to enhance the characteristics of damping the low-frequency sound. Meanwhile, when the engine rotational speed is high and the load is heavy, the low-frequency resonance chamber can be converted into an expansion chamber to reduce the back pressure and improve the engine output. In addition, since the opening and closing valve for converting the aforementioned chamber into either the low-frequency resonance chamber or the expansion chamber is of the butterfly type, it is possible to reduce the circulation resistance of the exhaust gas passing through the opening and closing valve when the valve is fully opened, thereby allowing the back pressure to be further reduced.

In addition, since the communicating passage constituting member having the opening and closing valve is formed into the shape of a gutter, the communicating passage can be formed on the outer shell by making use of a part of the outer shell as a part of its constituent walls. As a result, the communicating passage can be provided effectively in a corner space inside the muffler. For that reason, restrictions imposed on the inner pipe are small so that the inner pipe can be provided with a wide sectional area. As a result, the flow rate under control can be increased, thereby making it possible to sufficiently perform the desired objects including a reduction in the back pressure and the sound-damping effect.

In addition, if the aforementioned gutter-like communicating passage constituting member is provided on the outer surface of the outer shell, a part of the outer shell can be utilized as a part of the constituent walls so that the chambers inside the muffler can be made large.

Furthermore, if the communicating passage constituting member is constituted by a pipe, the valve for using in the passage can be not in a special shape but in an ordinary circular shape.

What is claimed is:

1. A muffler for exhaust gases comprising: an outer shell enclosing an interior space and including first and second walls therein partitioning said interior space into first, second and third chambers, an inlet pipe extending into and between said second and first chambers providing admission of gas into both said second and first chambers, within said second chamber, said inlet pipe having a wall having holes therethrough for the passage of gas, a gas outlet pipe communicating with said third chamber, passage for gas flow from said first chamber to said third chamber, said passage comprising a gutter-shaped member attached to an inner surface of said shell and bypassing said second chamber, and a butterfly-type valve within said passage for controlling the follow of gas therethrough.

2. A muffler according to claim 1 wherein said passage comprises a gutter-shaped member mounted on an outer surface of said shell, said shell having openings therethrough providing communication between said member and said first and third chambers.

3. A muffler according to claim 1 wherein said passage comprises an open-ended pipe disposed within said outer shell.

4. A muffler according to claim 1 wherein said first wall is disposed between said second and said third chambers and has an opening therethrough providing for flow of gas therebetween, and said second wall being disposed between said second and said first chambers and preventing any significant flow of gas therebetween.

5. A muffler for exhaust gasses comprising: an outer shell enclosing an interior space and including first and second walls therein partitioning said interior space into first, second and third chambers, said second chamber being disposed between said first and third chambers, said first wall being disposed between said second and said third chambers and having an opening therethrough providing for flow of gas therebetween, and said second wall being disposed between said second and said first chambers and preventing any significant flow of gas therebetween, an inlet pipe extending into and between said second and first chambers providing admission of gas into both said second and first chambers, a gas outlet pipe communicating with said third chamber, a passage for gas flow from said first chamber to said third chamber, said passage bypassing said second chamber, and a butterfly-type valve within said passage for controlling the flow of gas therethrough.

6. A muffler for exhaust gases comprising:

an outer shell enclosing an interior space and walls therein partitioning said interior space into a plurality of chambers including a first chamber, a second chamber and a third chamber, said second chamber being located between said first and said third chambers and adjacent to said first chamber;

a gas inlet pipe extending from an outside of said outer shell, through said second chamber, and opening into said first chamber, said inlet pipe having a wall formed with a plurality of through-holes opened to said second chamber;

a gas outlet pipe communicating with said third chamber;

a passage for gas flow from said first chamber to said third chamber, said passage bypassing said second chamber; and a butterfly-type valve within said passage for controlling the flow of gas therethrough.

7. A muffler according to claim 6 wherein said passage is defined between a portion of an inner surface of said shell and a gutter-shaped member attached to the inner surface of said shell.

8. A muffler according to claim 6 wherein said passage is defined between a portion of an outer surface of said shell and a gutter-shaped member mounted on the outer surface of said shell, said shell having openings therethrough providing communication between said member and said first and third chambers.

* * * * *